US007712736B2

(12) United States Patent
Chinzei

(10) Patent No.: US 7,712,736 B2
(45) Date of Patent: May 11, 2010

(54) PRINTER APPARATUS WITH CAM DAMPENED TRAY

(75) Inventor: Kiyoshi Chinzei, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 648 days.

(21) Appl. No.: 11/174,932

(22) Filed: Jul. 5, 2005

(65) Prior Publication Data

US 2006/0012108 A1 Jan. 19, 2006

(30) Foreign Application Priority Data

Jul. 9, 2004 (JP) ..... 2004-203658

(51) Int. Cl.
*B65H 1/26* (2006.01)

(52) U.S. Cl. ..... 271/157; 271/160

(58) Field of Classification Search ..... 271/157, 271/160, 118, 162; 74/567–569
See application file for complete search history.

(56) References Cited

U.S. PATENT DOCUMENTS 3,219,090 A * 11/1965 Cislo ..... 152/7
5,358,230 A * 10/1994 Ikemori et al. ..... 271/114

FOREIGN PATENT DOCUMENTS

JP 04-350033 12/1992
JP 5-301644 11/1993
JP 08-225167 9/1996
JP 11-334903 12/1999
JP 2003-221132 8/2003

OTHER PUBLICATIONS

Patent Abstracts of Japan, Publication No. 2003-221132, Publication Date: Aug. 5, 2003, 1 page.
Patent Abstracts of Japan, Publication No. 4-350033, Publication Date: Dec. 4, 1992, 1 page.
Patent Abstracts of Japan, Publication No. 8-225167, Publication Date: Sep. 3, 1996, 1 page.
Patent Abstracts of Japan, Publication No. 11-334903, Publication Date: Dec. 7, 1999, 1 page.
Japanese Office Action for Japanese Application No. 2004-203658, mailed on Dec. 16, 2008 (4 pages).
Patent Abstracts of Japan for Japanese Publication No. 05-301644, Publication date Nov. 16, 1993 (1 page).

* cited by examiner

*Primary Examiner*—Patrick H Mackey
*Assistant Examiner*—Gerald W McClain
(74) *Attorney, Agent, or Firm*—Osha • Liang LLP

(57) ABSTRACT

A printer apparatus includes a paper cater plate portion for carrying paper on which an image is printed, a prescribed shaft portion arranged above the paper carrier plate portion, a paper feed roller for feeding the paper provided on the shaft portion, a pushing member for pushing the paper carrier plate portion toward the paper feed roller, a cam provided on the shaft portion, and a cam abutment portion provided in the paper cater plate portion and abutting on the earn. The cam is formed from a resin and includes a cut-out portion so that a portion of the cam abutting on the cam abutment portion when the paper cater plate portion is lifted is elastic.

7 Claims, 6 Drawing Sheets

PRINTER APPARATUS WITH CAM DAMPENED TRAY

BACKGROUND OF THE INVENTION

1. Field of the Invention

The present invention relates to a printer apparatus, and more particularly to a printer apparatus achieving suppression of noise.

2. Description of the Background Art

A printer apparatus including a paper feed mechanism for feeding paper one by one by means of a paper feed roller and a friction pad has been available. Here, a printer apparatus proposed in Japanese Patent Laying-Open No. 2003-221132 will be described by way of example. In the printer apparatus of this type, as shown in FIG. 10, a paper feed roller 106 and a friction pad 105 are disposed above a paper carrier plate 102 for carrying the paper. Paper feed roller 106 is attached to a prescribed shaft portion 104.

A spring 108 for pushing paper carrier plate 102 upward is disposed below paper carrier plate 102. In order to lift paper carrier plate 102 by making use of pushing force of spring 108 concurrently with rotation of paper feed roller 106, a cam 110 is attached to shaft portion 104, and a cam abutment portion 112 abutting on cam 110 is provided in paper carrier plate 102.

In this printer apparatus, cam 110 shown in FIG. 10 is initially in abutment on cam abutment portion 112. Then, as shown in FIG. 11, cam 110 rotates in a direction shown with an arrow 131, and a state where cam 110 abuts on cam abutment portion 112 is released. Then, paper carrier plate 102 is lifted and paper 103 is fed by paper feed roller 106 and friction pad 105. Here, in order to mitigate impact due to sudden lifting of paper carrier plate 102 as well as to suppress noise, an elastic member 113 such as a leaf spring is attached to shaft portion 104 in a manner adjacent to cam 110. The paper feed mechanism in a conventional printer apparatus has thus been structured.

On the other hand, the conventional printer apparatus suffers from the following disadvantages. As described above, in order to mitigate impact due to sudden lifting of paper carrier plate 102 as well as to suppress noise, an additional member such as a leaf spring serving as elastic member 113 has been necessary. Moreover, such an additional elastic member 113 should be attached to shaft portion 104 in a manner adjacent to cam 110. Accordingly, the number of parts as well as the number of assembly steps have increased, which has turned out as obstacles in reducing manufacturing cost.

SUMMARY OF THE INVENTION

The present invention was made to solve the above-described problems. An object of the present invention is to provide a printer apparatus achieving suppression of noise by mitigating impact made by a paper carrier plate without increasing manufacturing cost.

A printer apparatus according to the present invention includes a paper carrier plate portion, a prescribed shaft portion, a paper feed roller, a pushing member, a cam, and a cam abutment portion. The paper carrier plate portion carries paper on which an image is printed. The prescribed shaft portion is arranged above the paper carrier plate portion. The paper feed roller for feeding the paper is provided on the shaft portion. The pushing member pushes the paper carrier plate portion toward the paper feed roller. The cam is provided on the shaft portion. The cam abutment portion is provided in the paper carrier plate portion and abuts on the cam. The cam is formed from a resin and includes a cut-out portion so that a portion of the cam abutting on the cam abutment portion when the paper carrier plate portion is lifted is elastic. It is noted that the cut-out portion used herein refers to a portion formed by hollowing out a member in a manner penetrating from one end to the other end.

According to this structure, the cut-out portion is provided in the portion of the cam abutting on the cam abutment portion when the paper carrier plate portion is lifted in order to feed the paper. Therefore, in the cam formed from the resin, the cut-out portion and a peripheral portion of the cam surrounding the cut-out portion from an outer circumference and having a smaller thickness in a radial direction attain a function as buffer members. As a result, the cam itself can mitigate the impact caused when the cam abutment portion again abuts on the cam, and serve to suppress noise in the printer apparatus, without using an additional member such as a leaf spring.

Another printer apparatus according to the present invention includes a paper carrier plate portion, a pushing member, and a cam. The paper carrier plate portion carries paper on which an image is printed. The pushing member pushes the paper carrier plate portion upward. The cam abuts on the paper carrier plate portion, and permits lifting of the paper carrier plate portion as a result of pushing force of the pushing member in feeding the paper. At least one of the cam and a portion abutting on the cam in the paper carrier plate portion is provided with an elastic portion in an area where the cam and the portion abut on each other when the paper carrier plate portion is lifted.

According to this structure, at least one of the cam and the portion abutting on the cam in the paper carrier plate portion includes the elastic portion in the area where they abut on each other when the paper carrier plate portion is lifted for feeding the paper. Therefore, the cam itself or the paper carrier plate portion itself can mitigate the impact caused when the cam abutment portion again abuts on the cam, and serve to suppress noise in the printer apparatus, without using an additional member such as a leaf spring.

According to one manner of such an elastic portion, the cam is formed from a resin and has a cut-out portion, and the elastic portion includes the cut-out portion and a peripheral portion of the cam circumferentially surrounding the cut-out portion.

In addition, when the elastic portion is formed in the cam, the peripheral portion of the cam may be continuously formed such that the cut-out portion is closed in a circumferential direction. Alternatively, the peripheral portion of the cam may have a discontinuous portion formed on one side in the circumferential direction so as to avoid enclosure of the cut-out portion in the circumferential direction. Alternatively, the elastic portion may include an elastic member provided around an outer circumference of the cam.

According to another manner of the elastic portion, the portion abutting on the cam in the paper carrier plate portion may be formed from a resin and have a cut-out portion, and the elastic portion may include a portion of the cam abutment portion circumferentially surrounding the cut-out portion.

In this case as well, the paper carrier plate portion itself can mitigate the impact caused when the cam abutment portion again abuts on the cam, and serve to suppress noise in the printer apparatus, without using an additional member such as a leaf spring.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
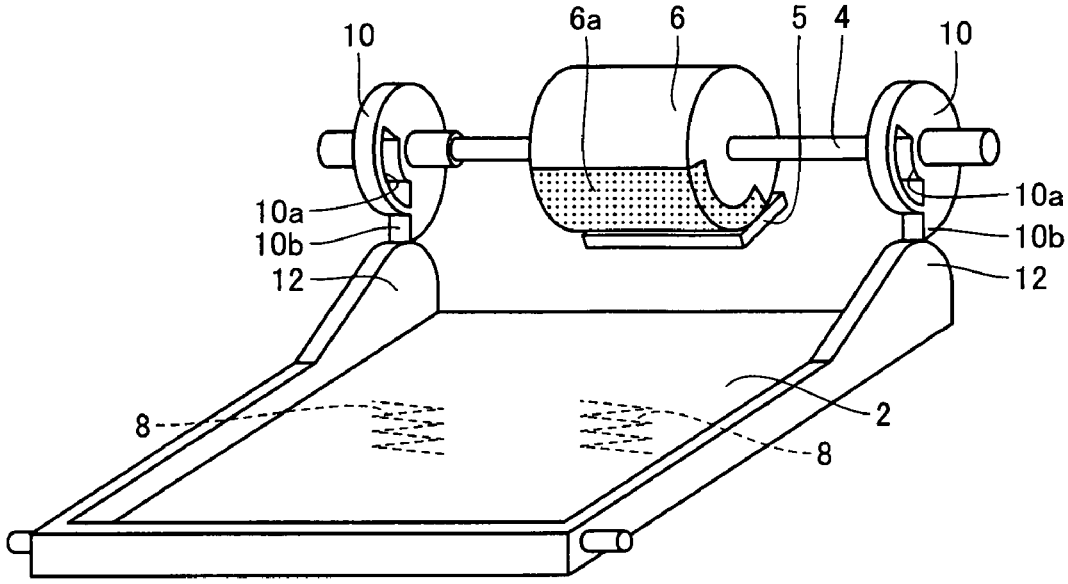
FIG. 1 is a perspective view showing a paper feed mechanism in a printer apparatus according to an embodiment of the present invention.

A paper feed mechanism in a printer apparatus according to the embodiment of the present invention will now be described. As shown in FIG. 1, a paper carrier plate 2 for carrying the paper on which an image is printed is disposed in the printer apparatus. A paper feed roller 6 and a friction pad 5 are disposed above paper carrier plate 2. Paper feed roller 6 is attached to a prescribed shaft portion 4. In order to reliably catch and feed the paper, for example, rubber 6*a* is formed around paper feed roller 6.

A spring 8 for pushing paper carrier plate 2 upward is disposed below paper carrier plate 2. In order to lift paper carrier plate 2 by making use of pushing (elastic) force of spring 8 concurrently with rotation of paper feed roller 6, a cam 10 including a stepped portion 10*b* is attached to shaft portion 4. Meanwhile, a cam abutment portion 12 abutting on cam 10 is provided in paper carrier plate 2. Cam 10 is formed, for example, from a resin.

Figure 2:
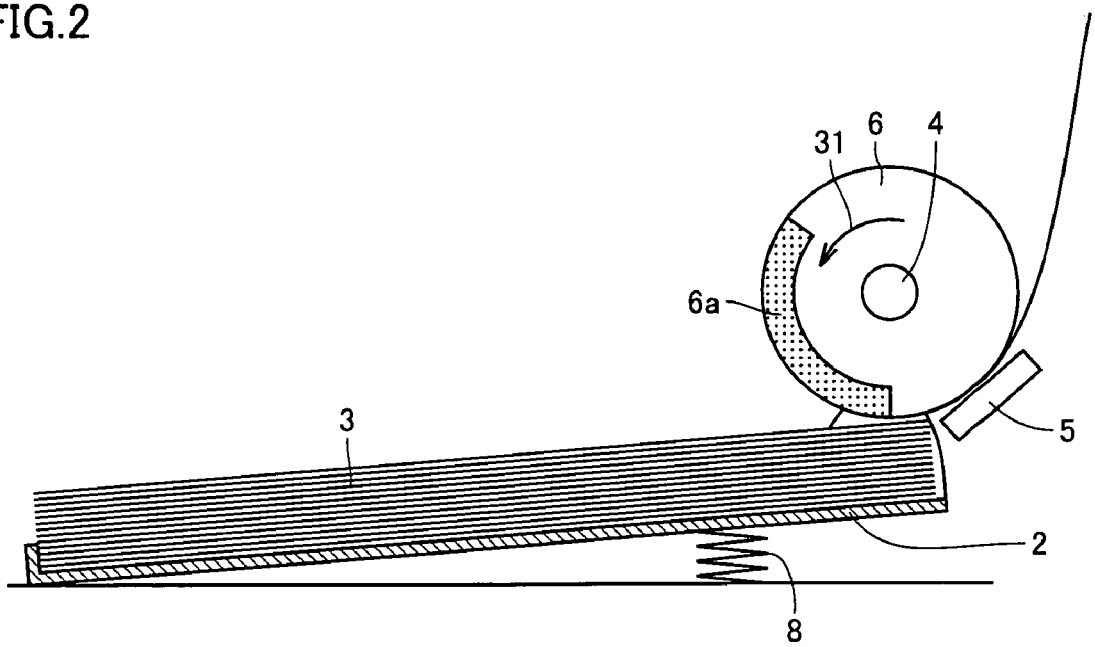
FIG. 2 is a side view of a manner of paper feed in the embodiment.

As will be described later, in order to mitigate impact caused when paper carrier plate 2 is lifted as a result of rotation of cam 10 and release from an abutting state of cam 10 on cam abutment portion 12, a prescribed cut-out portion 10*a* is provided. As shown in FIG. 2, while paper carrier plate 2 is lifted, paper 3 is fed by paper feed roller 6 and friction pad 5.

Figure 3:
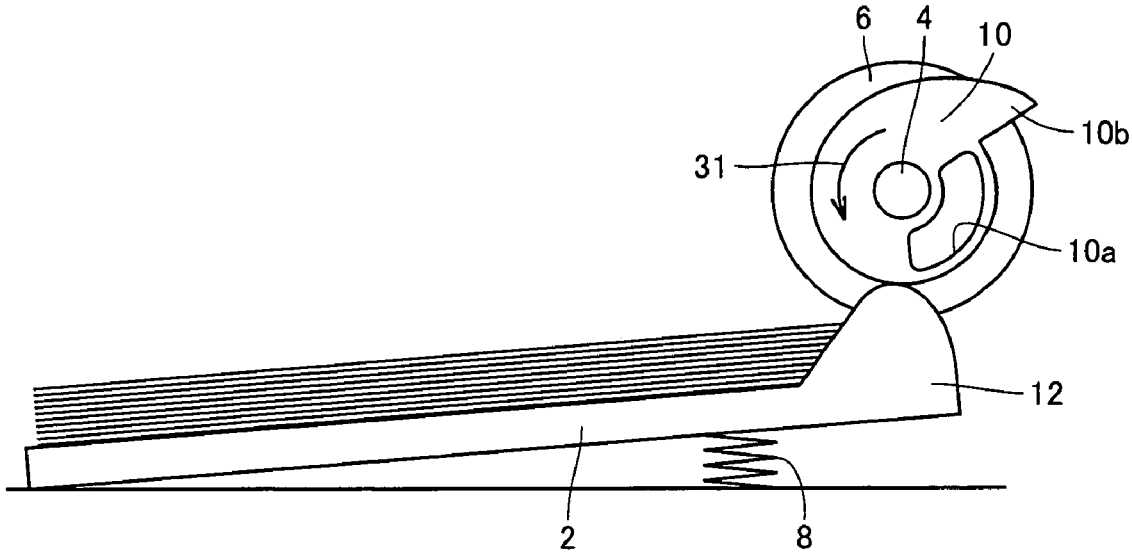
FIG. 3 is a side view of one state illustrating an operation for paper feed in the printer apparatus in the embodiment.
Figure 4:
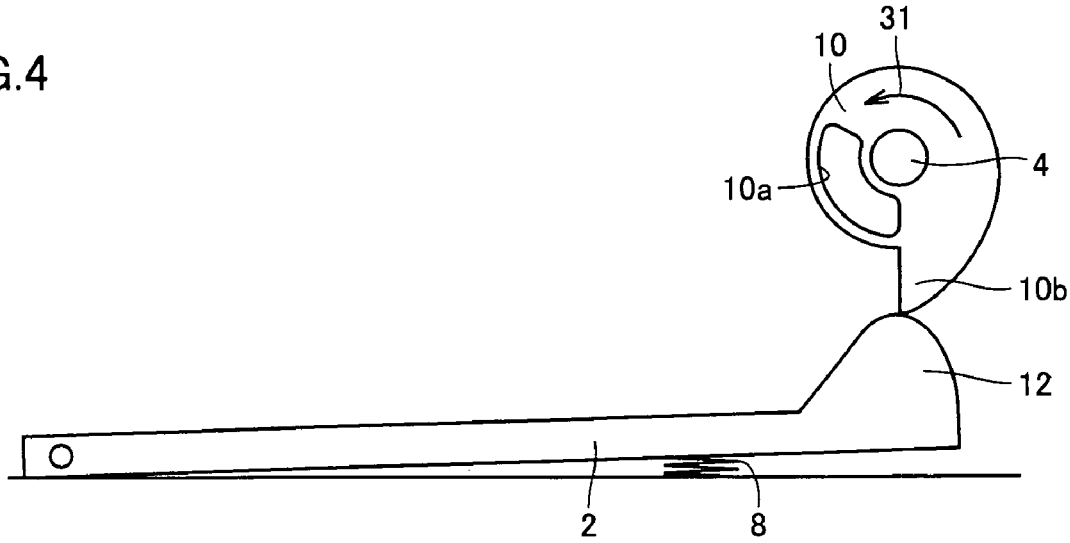
FIG. 4 is a side view of a state subsequent to the state shown in FIG. 3 in the embodiment.

An operation of the paper feed mechanism of the printer apparatus described above will now be discussed. Initially, when a paper feed operation is started by exiting from a stand-by state, as shown in FIG. 3, cam 10 starts to rotate together with shaft portion 4 in a direction shown with an arrow 31. As cam 10 continues to rotate, stepped portion 10*b* of cam 10 abuts on cam abutment portion 12 as shown in FIG. 4.

When cam 10 further rotates, cam abutment portion 12 is released from such a state as pressed from above by stepped portion 10*b*. Thereafter, cam abutment portion 12 is lifted by the elastic force of spring 8, and again abuts on cam 10. Here, cam abutment portion 12 abuts on a peripheral portion 10*c* around cut-out portion 10*a* of cam 10.

While paper carrier plate 2 is lifted, the paper carried on paper carrier plate 2 is fed by paper feed roller 6 as shown in FIG. 2. By repeating the operation described above, the paper carried on paper carrier plate 2 is fed one by one.

Figure 5:
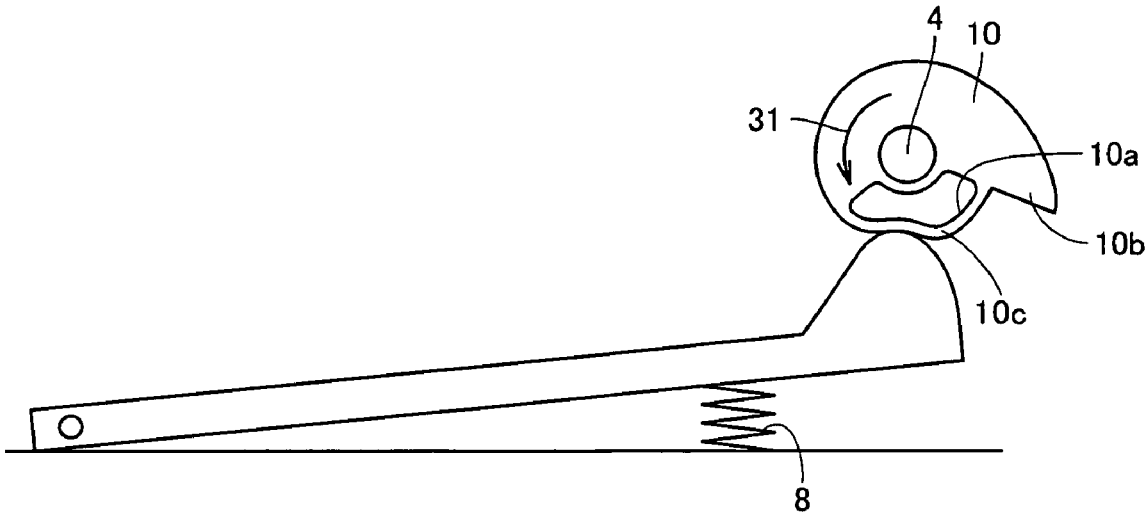
FIG. 5 is a side view of a state subsequent to the state shown in FIG. 4 in the embodiment.

In the paper feed mechanism of the printer apparatus described above, after cam abutment portion 12 is released from such a state as pressed from above by stepped portion 10*b* of cam 10, paper carrier plate 2 is lifted by the elastic force of spring 8, whereby a paper feed operation is performed. Cam 10 is provided with cut-out portion 10*a* in an area where cam abutment portion 12 again abuts on cam 10 when paper carrier plate 2 is lifted, as shown in FIGS. 5 and 6.

Accordingly, in cam 10 formed from the resin, cut-out portion 10*a* and peripheral portion 10*c* of the cam surrounding cut-out portion 10*a* from the outer circumference and having a smaller thickness in a radial direction attain a function as buffer members. Therefore, cam 10 itself can mitigate the impact caused when cam abutment portion 12 again abuts on cam 10, and serve to suppress noise in the printer apparatus, without using an additional member such as a leaf spring.

Figure 6:
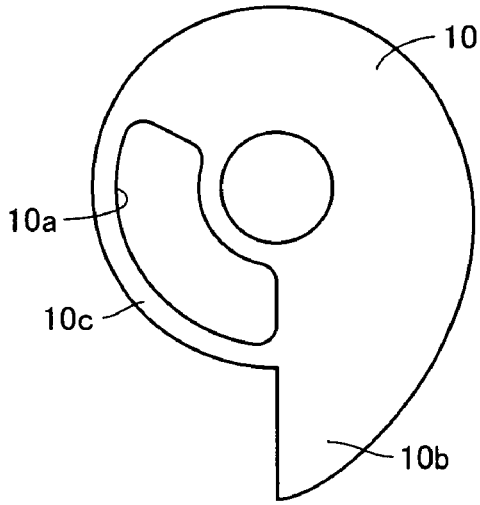
FIG. 6 is a side view showing one example of a cam applied to the printer apparatus in the embodiment.
Figure 7:
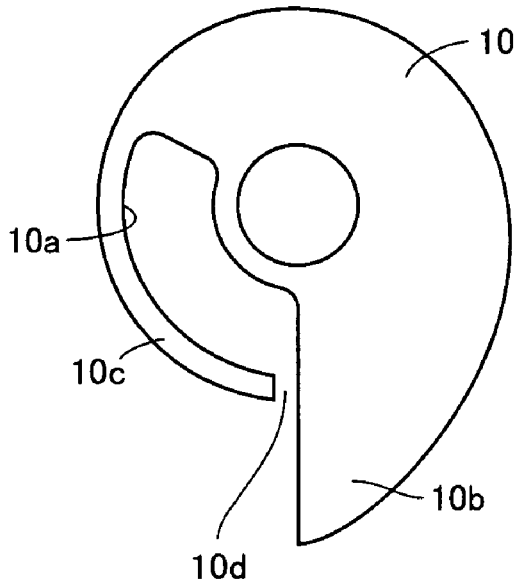
FIG. 7 is a side view showing another example of a cam applied to the printer apparatus in the embodiment.
Figure 8:
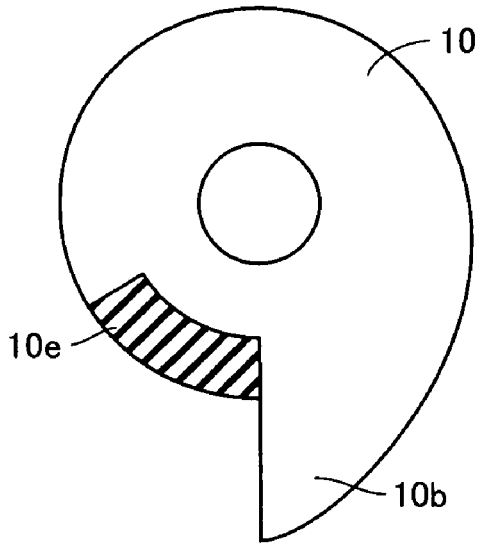
FIG. 8 is a side view showing yet another example of a cam applied to the printer apparatus in the embodiment.

In addition to the cam as shown in FIG. 6 provided with the peripheral portion such that the cut-out portion is closed in a circumferential direction, a cam as shown in FIG. 7 may be employed, which is provided with a discontinuous portion 10*d* between stepped portion 10*b* and peripheral portion 10*c* of the cam that surrounds cut-out portion 10*a* from the outer circumference so as not to close cut-out portion 10*a* in the circumferential direction. As a result of provision of discontinuous portion 10*d*, peripheral portion 10*c* of the cam is supported solely by one side of a cam body. Therefore, the impact can more effectively be mitigated. Moreover, as shown in FIG. 8, cam 10 having an elastic member 10*e* such as rubber attached to a part of the surface of cam 10 abutting on cam abutment portion 12 may be employed.

Figure 9:
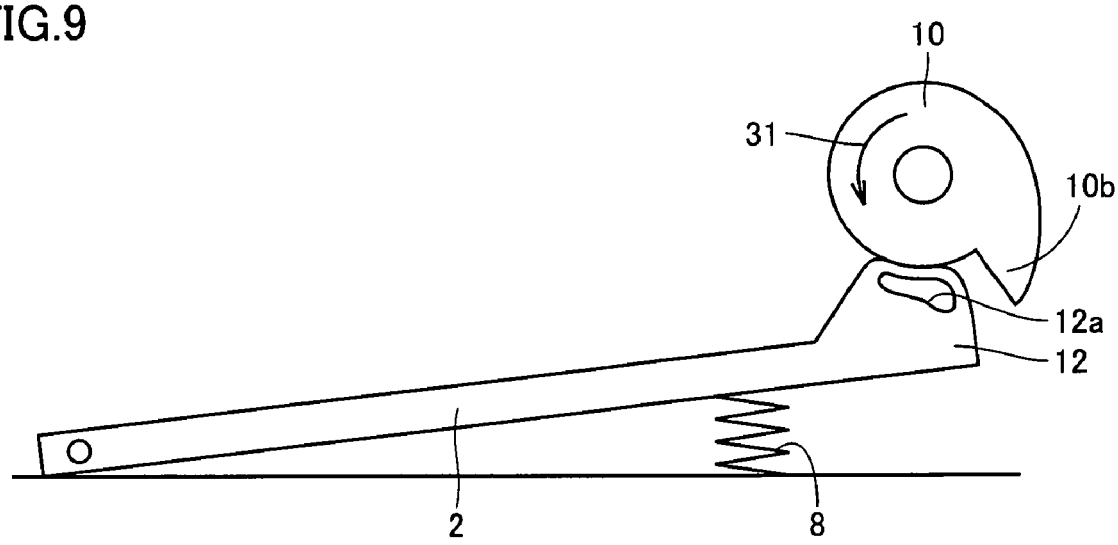
FIG. 9 is a side view showing one example of a cam abutment portion applied to the printer apparatus in the embodiment.
Figure 10:
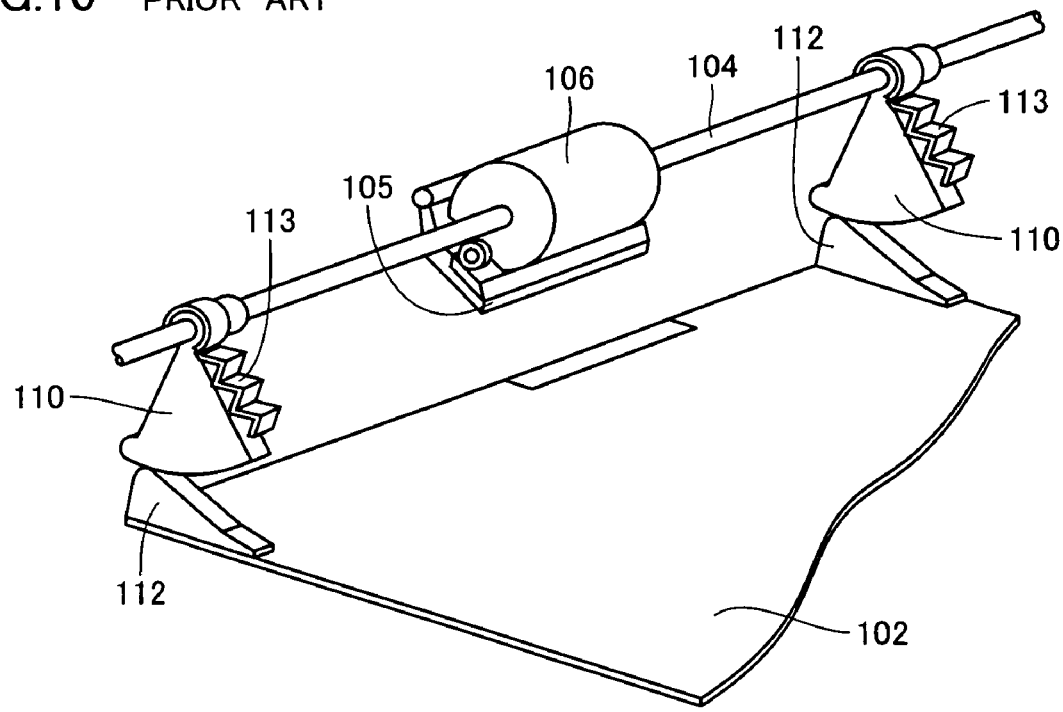
FIG.10 PRIOR ART
FIG. 10 is a perspective view showing a paper feed mechanism in a conventional printer apparatus.
Figure 11:
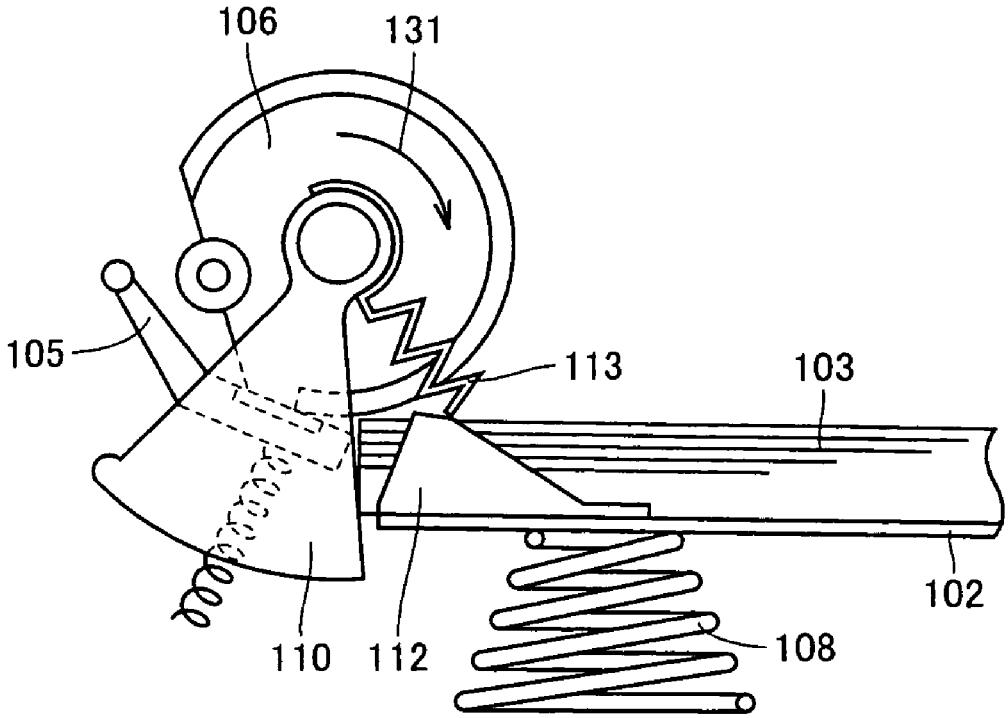
FIG.11 PRIOR ART
FIG. 11 is a side view showing a manner of paper feed in the conventional printer apparatus.

Alternatively, instead of providing the cut-out portion in the cam, a cut-out portion 12*a* may be provided in cam abutment portion 12, as shown in FIG. 9. In this case as well, cam abutment portion 12 having cut-out portion 12*a* attains a function as the buffer member, and cam abutment portion 12 itself can mitigate the impact caused when cam abutment portion 12 again abuts on cam 10, and serve to suppress noise in the printer apparatus, without using an additional member such as a leaf spring.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer apparatus comprising:

a paper carrier plate portion for carrying paper on which an image is printed;

a prescribed shaft portion arranged above said paper carrier plate portion;

a paper feed roller for feeding the paper, provided on said shaft portion;

a pushing member for pushing said paper carrier plate portion toward said paper feed roller;

a cam provided on said shaft portion; and a cam abutment portion provided in said paper carrier plate portion and abutting on said cam; wherein an outer circumference of said cam includes a stepped portion having a first end and a second end, said first end pushing said paper carrier plate portion away from said paper feed roller against said pushing member when said stepped portion abuts on said cam abutment portion, said stepped portion disposed in a substantially radial direction of said cam, and said cam is formed from a resin and includes a cut-out portion in an area of said cam other than the stepped portion so that a portion of said cam abutting on said cam abutment portion when said paper carrier plate portion is pushed toward said paper feed roller is substantially more elastic than the stepped portion.

2. A printer apparatus comprising:

a paper carrier plate portion for carrying paper on which an image is printed;

a pushing member for pushing said paper carrier plate portion upward; and a cam abutting on said paper carrier plate portion and permitting lifting of said paper carrier plate portion as a result of pushing force of said pushing member in feeding the paper; wherein an outer circumference of said cam includes a stepped portion having a first end and a second end, said first end pushing said paper carrier plate portion downward when said stepped portion abuts on said paper carrier plate portion, said stepped portion disposed in a substantially radial direction of said cam, at least one of a portion of said cam other than said stepped portion and a portion of said paper carrier plate portion abutting on said cam is adapted to mitigate impact in an area where said portion of said cam and said portion of said paper carrier plate portion abut on each other when said paper carrier plate portion is lifted, and the at least one of the portions adapted to mitigate impact is more elastic than surrounding portions thereof.

3. The printer apparatus according to claim 2, wherein said cam is formed from a resin and has a cut-out portion, and said at least one of a portion of said cam other than said stepped portion and a portion of said paper carrier plate portion abutting on said cam includes said cut-out portion and a peripheral portion of said cam circumferentially surrounding said cut-out portion.

4. The printer apparatus according to claim 3, wherein said peripheral portion of said cam is continuously formed such that said cut-out portion is closed in a circumferential direction.

5. The printer apparatus according to claim 3, wherein said peripheral portion of said cam has a discontinuous portion formed on one side in a circumferential direction so as to avoid enclosure of said cut-out portion in the circumferential direction.

6. The printer apparatus according to claim 2, wherein said at least one of a portion of said cam other than said stepped portion and a portion of said paper carrier plate portion abutting on said cam includes an elastic member provided around the outer circumference of said cam.

7. The printer apparatus according to claim 2, wherein said portion abutting on said cam in said paper carrier plate portion is formed from a resin and has a cut-out portion, and said portion adapted to mitigate impact includes a portion of said portion abutting on said cam circumferentially surrounding said cut-out portion.

* * * * *